US007424253B2

(12) United States Patent
Baker et al.

(10) Patent No.: US 7,424,253 B2
(45) Date of Patent: Sep. 9, 2008

(54) TONER METERING DEVICE

(75) Inventors: Ronald Willard Baker, Versailles, KY (US); Marc Cousoulis, Versailles, KY (US); Michael Craig Leemhuis, Nicholasville, KY (US); Gregory Lawrence Ream, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 304 days.

(21) Appl. No.: 11/208,813

(22) Filed: Aug. 22, 2005

(65) Prior Publication Data

US 2007/0041751 A1 Feb. 22, 2007

(51) Int. Cl.
*G03G 15/08* (2006.01)

(52) U.S. Cl. ..... 399/284

(58) Field of Classification Search ..... 399/260, 399/273, 274, 283, 284
See application file for complete search history.

(56) References Cited

U.S. PATENT DOCUMENTS 4,586,460 A * 5/1986 Kohyama et al. ..... 399/281
4,625,676 A * 12/1986 Sakamoto et al. ..... 399/274
5,233,390 A * 8/1993 Fujimoto ..... 399/126
5,239,345 A 8/1993 Kikuchi et al.
5,303,010 A * 4/1994 Takano et al. ..... 399/126
5,557,380 A * 9/1996 Maeda et al. ..... 399/260
5,697,021 A 12/1997 Watanabe et al.
6,078,771 A 6/2000 Buchanan et al.
6,181,904 B1 1/2001 Burdette et al.
6,256,471 B1 7/2001 Sato et al.
6,263,180 B1 * 7/2001 VanLaeken et al. ..... 399/284
6,671,485 B2 12/2003 Hirano
6,697,594 B1 2/2004 Murphy et al.
6,801,740 B2 10/2004 Ito et al.
6,907,210 B2 * 6/2005 Wazana et al. ..... 399/109
7,218,882 B2 * 5/2007 Toba et al. ..... 399/284

FOREIGN PATENT DOCUMENTS

JP 01219859 A * 9/1989
JP 03068973 A * 3/1991
JP 09043974 A * 2/1997
JP 09134072 A * 5/1997
JP 2003215911 A * 7/2003

* cited by examiner

*Primary Examiner*—Robert Beatty
(74) *Attorney, Agent, or Firm*—Steven J. Grossman

(57) ABSTRACT

The present invention relates to an apparatus and method that is capable of adjusting the position of a developing agent metering device. Developing agent may therefore be metered in an image forming device.

9 Claims, 6 Drawing Sheets

TONER METERING DEVICE

FIELD OF INVENTION

The present invention relates to a device and method for adjusting a developing agent metering device in relation to a component that supplies developing agent in an image forming device.

BACKGROUND

Developer cartridges may be used in a number of printing systems, such as electrophotographic devices. A developing agent, such as toner, may be transferred onto a component that supplies developing agent, such as a developer roll, from a developing agent addition roll. The developing agent may be metered on the component that supplies developing agent using a developing agent metering device. A nip be may formed between the developing agent metering device and the component that supplies developing agent through which the developing agent may flow.

Accordingly, a relatively thin uniform layer of developing agent may be formed on the component surface which may be brought within the proximity of a photoconductor where the latent image may then be developed. Build-up of developing agent and/or contaminants may occur in the region between the developing agent metering device and the component for supplying developing agent. This build-up may cause a number of printing defects such as an interruption of the regular toner flow.

SUMMARY

An exemplary embodiment of the present invention relates to an apparatus and method that is capable of adjusting the position of a developing agent metering device. The device may include a support member capable of supporting the device and a component which supplies developing agent which engages the metering device. The metering device may tangentially engage the component and form a tangent location. The metering device has a length and an end section and the support member is capable of adjusting the distance between the end section and the tangent location.

BRIEF DESCRIPTION OF DRAWINGS

Features and advantages of the present invention are set forth herein by description of embodiments consistent with the present invention, which description should be considered in conjunction with the accompanying drawings, wherein.

DETAILED DESCRIPTION

The present invention relates in exemplary embodiment to an apparatus and method for positioning a developing agent metering device within an image forming device. The development agent may be used in a image forming apparatus, such as a printer, copier, fax, etc. that uses a developing agent. The development agent may be toner or ink or any other image forming substance. An exemplary embodiment of an image forming device may be an electrophotographic printing device; however, other printing devices may be contemplated in the present invention.

Figure 1:
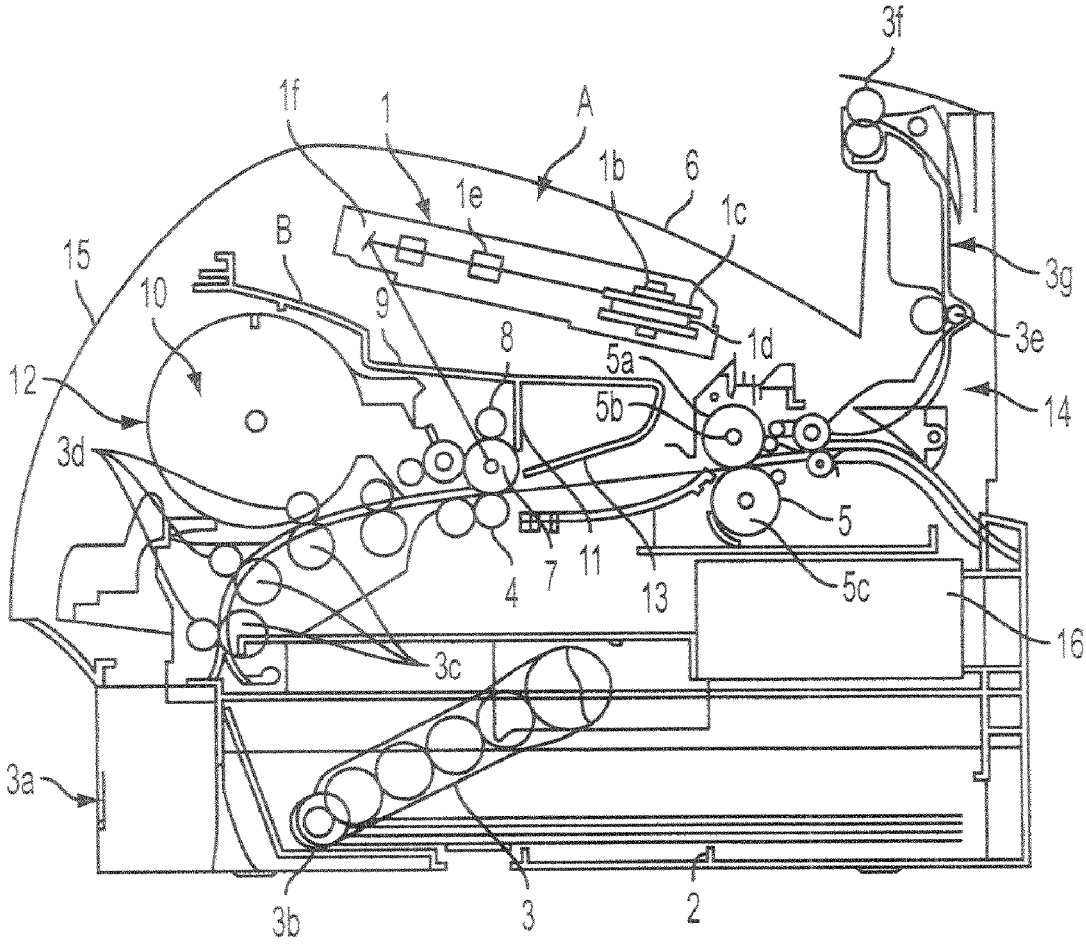
FIG. 1 is side view an exemplary embodiment relating to the present invention illustrating a laser printer.

One exemplary embodiment of an electrophotographic device may be a laser printer, illustrated in FIG. 1. The image-forming electrophotographic apparatus A may include the following components: an optical device, a feeding device, a transfer device, a fixing device, and a cartridge mounting device, described herein.

The optical device 1 may project a light image onto a photosensitive drum 7 by projecting light on the basis of image information read from an external apparatus or the like. As shown in FIG. 1, a laser diode 1*b*, a polygon mirror 1*c*, a scanner motor 1*d*, and an image-forming lens 1*e* may be housed inside an optical unit 1 of the main body 14 of the apparatus. When, for example, an image signal may be supplied from an external apparatus, such as a computer, word processor or imaging device, to the printer or to a microprocessor 16 within the printer, the laser diode 1*b* may emit light in response to the image signal, and projects the light onto the polygon mirror 1*c* as image light. Polygon mirror 1*c* may be rotated at high speed by the scanner motor 1*d*. The image light reflected by the polygon mirror 1*c* may be projected onto the photosensitive drum 7 via the image-forming lens 1*e* and reflecting mirror 1*f*. The surface of the photosensitive drum 7 may thus be selectively exposed to form a latent image corresponding to the image information.

The feeding device 3 for feeding the recording medium 2 (e.g., recording paper, cardstock, transparency or film sheet, envelopes, cloth, thin plate, etc.) may include the following components. A loading portion of a cassette 3*a* may be provided in the inner bottom portion of the main body 14 of the apparatus. Upon the input of an image formation start signal, the recording media 2 within the cassette 3*a* may be fed one-by-one from the top of the stack by a pickup roller 3*b*, feeding rollers 3*c* and follower rollers 3*d*, pressed against the feeding roller 3*c*.

A sheet of recording medium 2 may be fed to the nip portion between the photosensitive drum 7 and the transfer device 4 in synchronization with the performing of the image-formation operation described above, transferring the image to the recording medium. The recording medium 2 onto which a developed image has been transferred may be fed to the fixing device 5 and then ejected onto the ejection tray 6 by a pair of intermediate ejection rollers 3*e* and a pair of ejection rollers 3*f*. A pair of guide members 3*g* for guiding the feeding of the recording medium 2 may be provided between each of the above-mentioned pairs of rollers.

The transfer device 4 transfers the developed latent image or toner image formed on the photosensitive drum 7 in the image-forming section onto the recording medium 2. The transfer device 4 consists of the transfer roller 4 as shown in FIG. 1. That is, the recording medium 2 may be pressed by the transfer roller 4 against the photosensitive drum 7 of the loaded process cartridge B. A voltage having a polarity opposite that of the latent image formed on the photosensitive drum 7 may be applied to the transfer roller 4 so that the developing agent on the photosensitive drum 7 may be transferred to the recording medium 2.

The fixing device 5 may fix the developing agent image transferred to the recording medium 2 by applying heat and pressure to the recording medium 2 carrying the developing agent image. As shown in FIG. 1, the fixing device 5 may comprise a driving rotating roller 5*a* having a heater 5*b* therein, and a fixing (pressure) roller 5*c*, rotating in a driven manner in pressed contact with the drive roller 5*a*. More specifically, when the recording medium 2 to which the developing agent image has been transferred moves between drive roller 5*a* and fixing roller 5*c*, heat may be applied by the heater located in the driving rotating roller 5*a* and pressure may be applied to the recording medium by the fixing roller 5*c*, thereby causing the developing agent (which comprises a colorant and a thermoplastic component) on the recording medium 2 to melt and become fixed to the recording medium 2.

Furthermore, the microprocessor 16 may communicate with a computer, network, word processor or imaging device. The microprocessor 16 may also process data within the printer, including data related to sensors and computing algorithms.

A process cartridge loading device by which the process cartridge B is loaded into the image forming apparatus is disposed within the apparatus A. Loading and unloading of the process cartridge B to and from the main body 14 of the apparatus may be performed by opening an open/close cover 15. Open/Close cover 15 may be provided with a conventional hinge (not shown) so that it can be opened or closed, and is mounted in the upper portion of the main body 14 of the apparatus. Opening the open/close cover 15 may reveal a cartridge loading space provided inside the main body 14 of the apparatus and may include conventional left and right guide members (not shown) mounted on the left and right inner-wall surfaces of the main body 14. Each of these guide members may be provided with a guide for inserting the process cartridge or developing agent assembly B. The process cartridge or assembly B may be inserted into and along the guides, and by closing the open/close cover 15. Furthermore, the open/close cover 15 may be provided in communication with a sensor (not illustrated), which may be triggered by opening or closing said cover 15.

Figure 2:
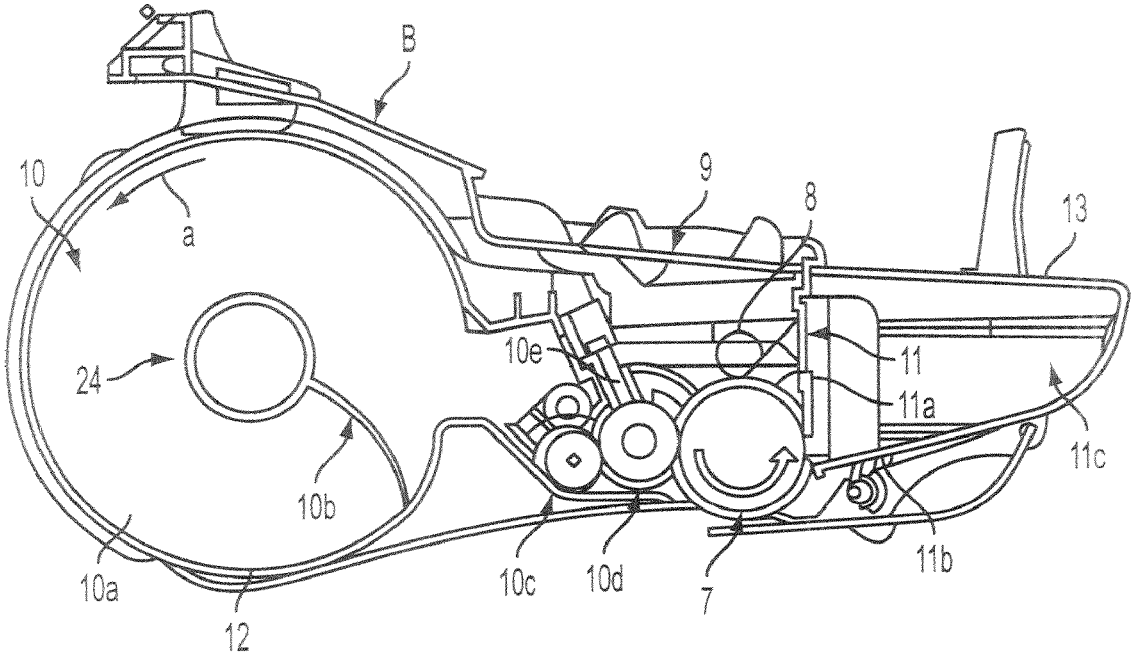
FIG. 2 is a side view of an exemplary embodiment of a developer cartridge.

The process cartridge or assembly B may comprise an image carrier and at least one process means. The process device may include a charging device for charging the surface of the image carrier, a developing device for forming a developing agent image on the image carrier, a cleaning device for cleaning the developing agent remaining on the surface of the image carrier, and the like. In the process cartridge B as shown in FIG. 2, the charging device 8, the exposure section 9, the developing device 10, and the cleaning device 11 may be arranged around a photosensitive drum 7, which is an image carrier. These elements may be housed within a frame member formed of the developing agent frame member 12 and the cleaning frame member 13 so that they may be formed into one unit, thus making it possible to load and unload the unit into and out of the main body 14 of the apparatus. The developer unit housing in frame member 12 may also be loaded into main body 14 separately from the PC-Cleaner unit housed in frame member 13. The process cartridge B may include the following elements: the photosensitive drum 7, the charging device 8, the exposure section 9, the developing device 10 and the cleaning device 11.

The photosensitive drum 7 may have an organic photosensitive layer coated onto the outer peripheral surface of a cylindrical drum base formed from aluminum. The photosensitive drum 7 may be rotatably mounted on a frame member of the cartridge and the driving force of a drive motor disposed in the main body 14 of the apparatus may be transmitted to a drum cap (not shown). As a result, the photosensitive drum 7 may be caused to rotate in the direction of the arrow.

The charging means 8 may be used to uniformly charge the surface of the photosensitive drum 7. Preferably, a so-called contact charging method in which the charging means 8 is mounted on frame member 13 may be used.

The charging means 8 may be brought into contact with the photosensitive drum 7 so that the charging means 8 contacts the photosensitive drum 7 during the image formation. A DC voltage may be applied to the charging means 8 and the surface of the photosensitive drum 7 may be uniformly charged.

An exposure section 9 exposes a light image projected from the optical means onto the surface of the photosensitive drum 7 uniformly charged by the charging roller 8 so that a latent image may be formed on the surface of the photosensitive drum 7. An opening 9 for guiding the light image onto the top surface of the photosensitive drum 7 may be provided to form the exposure section.

As shown in FIG. 2, the developing means may include a developing agent reservoir 10*a* or housing for the developing agent, and a developing agent engaging member or paddle 10*b*. The developing agent engaging member 10*b* or agitator may be provided within developing agent reservoir 10*a* and may rotate along path at as shown in FIG. 2 to circulate developing agent within the developing agent reservoir 10*a* and transfer the developing agent to a developing agent addition roll 10*c*. A developing agent supply component 10*d* may form a thin developing agent layer on the surface thereof as a result of its rotation against the developing agent addition roller 10*c* and may be pressed against the photosensitive drum 7.

The developing agent feeding member 10*b* may act as an agitator for the developing agent and may be generally configured as a paddle that extends substantially the width of the developing agent reservoir 10*a*. The size of the paddle 10*b* may be such that during rotation the outer end or tip of the paddle may come within close proximity to the inner surface of cylindrical wall 12 to agitate the developing agent and move it towards roll 10*c*. The paddle 10*b* may have a variety of configurations and may be substantially flat or slightly curved.

A developing agent metering device (also called a "doctor blade") 10*e* may be disposed adjacent the developing agent supply component 10*d* to regulate the thickness of the developing agent layer formed therebetween. An electric charge may be imparted to the developing agent by a biasing voltage on the doctor blade 10*e*.

As shown in FIG. 2, the cleaning means 11 may comprise a cleaning blade 11*a*, positioned in contact with the surface of the photosensitive drum 7 for scraping off the developing agent remaining on the photosensitive drum 7. The cleaning device 11 may also include a skimming seal 11*b*, positioned below the cleaning blade 11*a* and arranged in a relatively weak contact with the surface of the photosensitive drum 7, for retaining the developing agent which has been scraped off. A waste developing agent well 11*c* may also be included for storing the scraped-off waste developing agent. The developing agent frame member 12 may generally be cylindrical in shape so that the developing agent feeding member 10*b* may travel on a path a within the frame to agitate and feed developing agent without interfering with the frame member 12.

Figure 3:
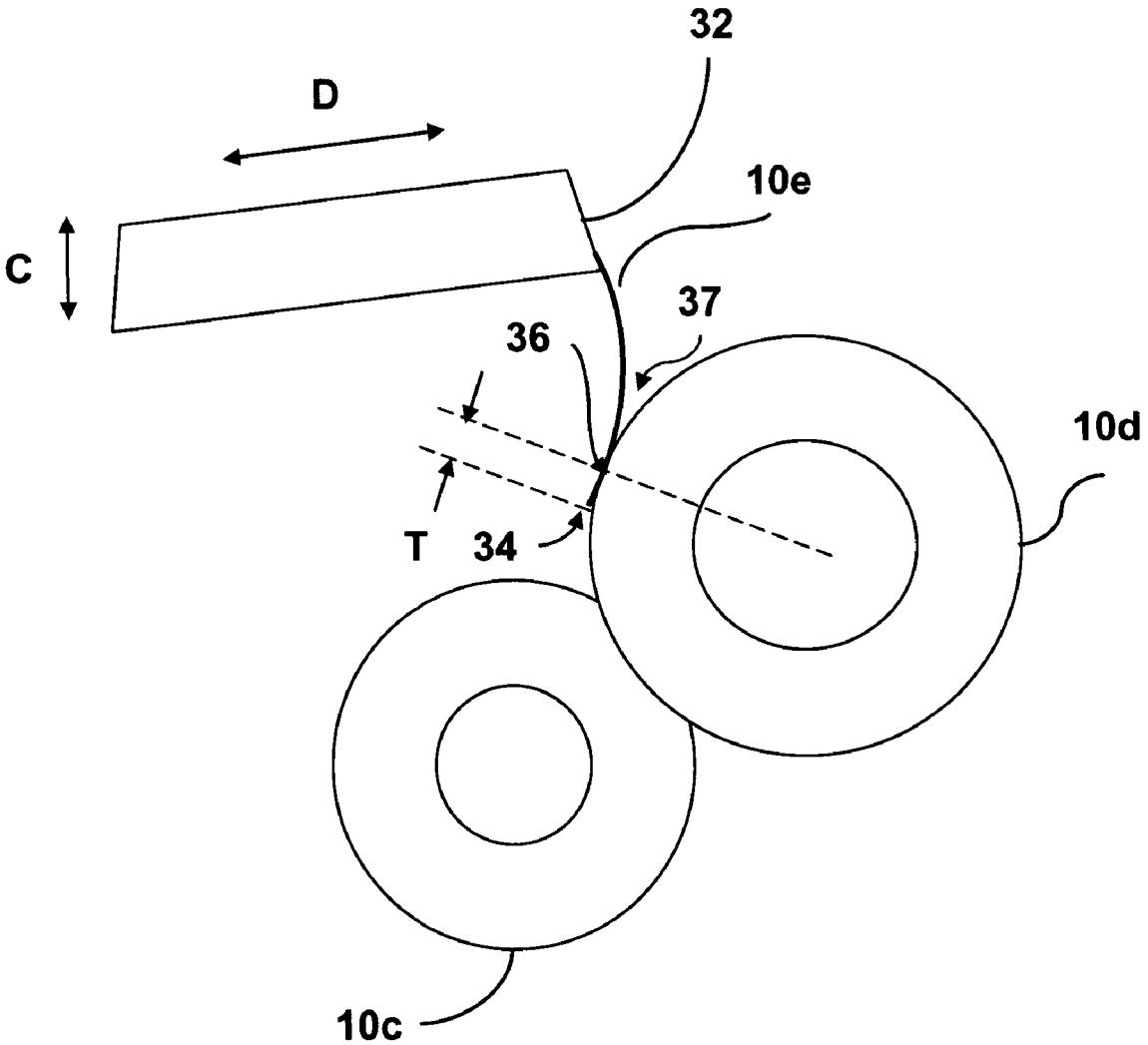
FIG. 3 is an illustration of an exemplary embodiment of a developing agent metering device and support member in relation to a component for supplying developing agent.

The present invention relates to the adjustment of the developing agent metering device illustrated in FIG. 3. Developing agent metering device 10*e* may be affixed to any physical support member feature such as a bracket 32 within the process cartridge B or electrophotographic device A. The developing agent metering device 10*e* may be affixed to bracket 32 by a number of methods, such as spot welding, a slotted aperture, adhesives or mechanical interlocks or anchoring devices.

The developing agent metering device 10*e* may be composed of a metallic material or a polymeric material or a combination of both metallic and polymeric materials, including but not limited to, phosphor bronze, stainless steel, aluminum, brass, beryllium copper, polymeric film, polyester, polycarbonate, polyetherimide, or combinations thereof. Furthermore, the developing agent metering device 10*e* may include a resin or grit particles dispersed throughout the surface which may include conductive carbon black, silicon carbide, etc. Additionally, the developing agent metering device 10*e* may be composed of conductive, nonconductive or a combination of conductive and non-conductive materials, including those materials mentioned herein.

The developing agent metering device 10*e* may be between 0.025 mm and 0.250 mm thickness, including any interval therebetween such as 0.075 mm, 0.125 mm, 0.175 mm, etc. The developing agent metering device 10*e* may be positioned such that a force is applied to the developing agent supply component 10*d*. The applied force may be between 1-20 Newtons, including all intervals therebetween such as 11 Newtons, 15 Newtons, 5 Newtons, etc. Furthermore, the contact area 36 of the developing agent metering device 10*e* on the developing agent supply component 10*d* may be between 0.5 mm to 1.5 mm, including all increments therebetween such as 0.8 mm, 1.1 mm, etc.

The thickness and uniformity of the developing agent coating on the developing agent supply component 10*d* may be regulated by the distance between the tip 34 of the developing agent metering device 10*e* and the tangent location of the developing agent metering device 10*e* on the developing agent supply component 10*d*, the distance defined by T. The tip to tangent distance T may be between about 0.1-2.0 mm including all values and increments therebetween.

In one exemplary embodiment the tip to tangent distance T may be between 0.6 mm to 1.4 mm, including all increments therebetween, including 0.6 mm to 1.1 mm, etc. The tip to tangent distance T may be adjusted to provide various monolayers of developing agent on the developing agent supply component. For example, a tip to tangent distance T of between about 0.6-1.4 mm may provide about 1-2 monolayers of developing agent on the developing agent supply component. Accordingly, the present invention provides a method to adjust the number of monolayers on the developing agent supply component by adjustment of the tip to tangent distance T of the developing agent metering device (e.g., a doctor blade).

In one embodiment, the tip 34 of the developing agent metering device 10*e* may be outside of the contact area. Stated another way, the tip 34 may not be touching the developing agent supply component 10*d* where the developing agent metering device 10*e* touches the developing agent supply component 10*d*. It should be appreciated, however, that the desired value of distance T may be affected by a number of factors including the total contact area of the developing agent metering device 10*e* on the developing agent supply component 10*d*, the force applied by the developing agent metering device 10*e* to the developing agent supply component 10*d*, the developing agent size, the developer size, or the developing agent supply component durometer.

In positioning the developing agent metering device 10*e* with respect to the developing agent supply component 10*d* problems in developing agent regulation may occur. When the T dimension may be too large, the developing agent may collect within the area before the nip 37 of the developing agent metering device 10*e* and the developing agent supply component 10*d* and interrupt the developing agent flow on the surface of the developing agent supply component 10*d*. This phenomenon may be referred to as "skid marks." Another phenomenon, referred to as "skiving," may occur where the distance T may not be large enough and more than a desired amount of developing agent is removed by the metering device. In one exemplary embodiment it has been found that skid marks may form when the tip to tangent distance T may be equal to or greater than about 1.1 mm. On the other hand, in one exemplary embodiment it has been found that skiving may occur when the tip to tangent distance T may be equal to or below about 0.6 mm. However, in the context of the present invention, those values for the tip to tangent distance T that may lead to either skid marks or skiving may be empirically determined for a given developing agent supply component and metering device.

With attention to FIG. 3, distance T may therefore be adjusted by adjusting the location of the developing agent metering device 10*e* and the bracket or surface 32 in either direction C, i.e. approximately perpendicular to the plane of the developer metering device or D, i.e. approximately parallel to the plane of the toner metering device. Adjustment of the bracket 32 in the C direction may be limited by the geometry of the developer housing 12 and may cause developing agent leakage. Where that is the case, it may be possible to provide for an adjustment in the D direction.

In one embodiment of the present invention, it may be possible to provide a bracket 32 which may be repositioned in the developer housing 12. Furthermore, shims may be used to engage the bracket 32 which then may serve to reposition the developing agent metering device 10*e* within the developing agent cartridge. Repositioning the bracket 32 within the developing agent metering device 10*e* may accommodate for lot to lot variation of the bracket or surface 32 without having to adjust the manufacturing tolerances of the bracket 32, developer housing 12 or developing agent supply component 10*d*.

Figure 5:
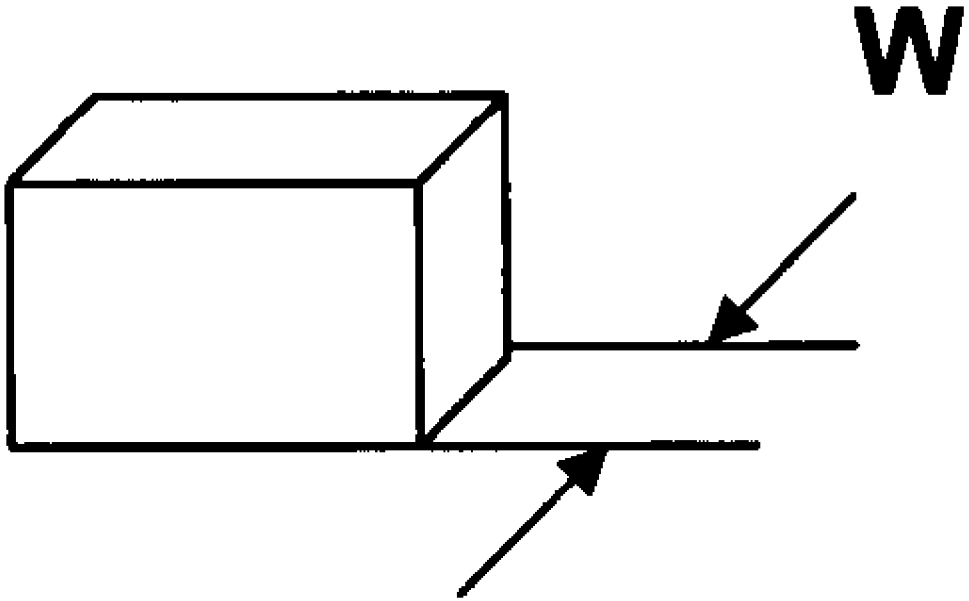
FIG. 5 is an exemplary embodiment of a shim contemplated in the present invention.

In one embodiment, the lot to lot variation of the bracket 32, developer housing 12 and/or the developing agent supply component 10*d* may be quantified. First the variation related to a population, such as a production lot of developer housing and developing agent supply components may be quantified. Then the magnitude of the statistical variation of a population such as a production lot of doctor blade extension length may be quantified. Based on the cumulative variation it may be possible to add shims to reposition the bracket 32 in relation to the developing agent supply component 10*d*. For example, the shim size may be determined by the standard deviation of a lot of brackets 32 manufactured. An exemplary shim is illustrated in FIG. 5. The shims may be sized by units having a width, W, between 0.05 mm and 2.0 mm, including all increments therebetween such as 0.05 mm, 0.1 mm, 0.2 mm, etc.

Figure 4:
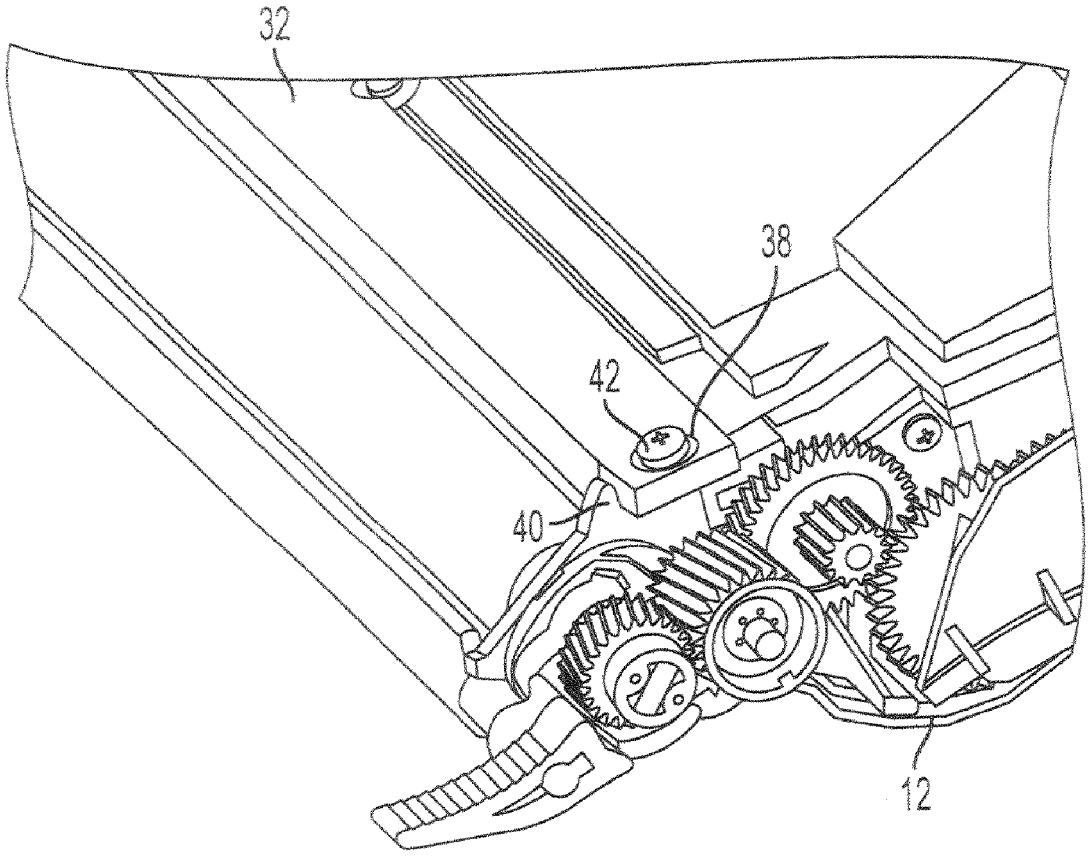
FIG. 4 relates to an exemplary embodiment of the present invention illustrating the support member in relation to a component for supplying developing agent.

Accordingly, in referring to FIG. 4, the present invention further relates to providing a physical feature for the support of the developing agent metering device such as a bracket 32 which may be adjusted in the developer housing 12 in the D direction (see FIG. 3). The bracket may be provided with at least one fixing slot 38 which may be sized to accommodate for adjusting the bracket 32 in the D direction according to the determined lot to lot variation of the development cartridge assembly. Accordingly, in one embodiment, these slots may be slightly oblong or rectangular in shape.

Shims may be placed between the bracket 32 and a nub 40 affixed to developer housing 12. Once the desired location for the bracket 32 is reached, the bracket 32 may then be affixed to the developer housing 12 using fasteners 42 such as screws or slips. Furthermore, upon final adjustment, the bracket 32 may be welded or fixed by an adhesive to the developer housing 12.

Figure 6:
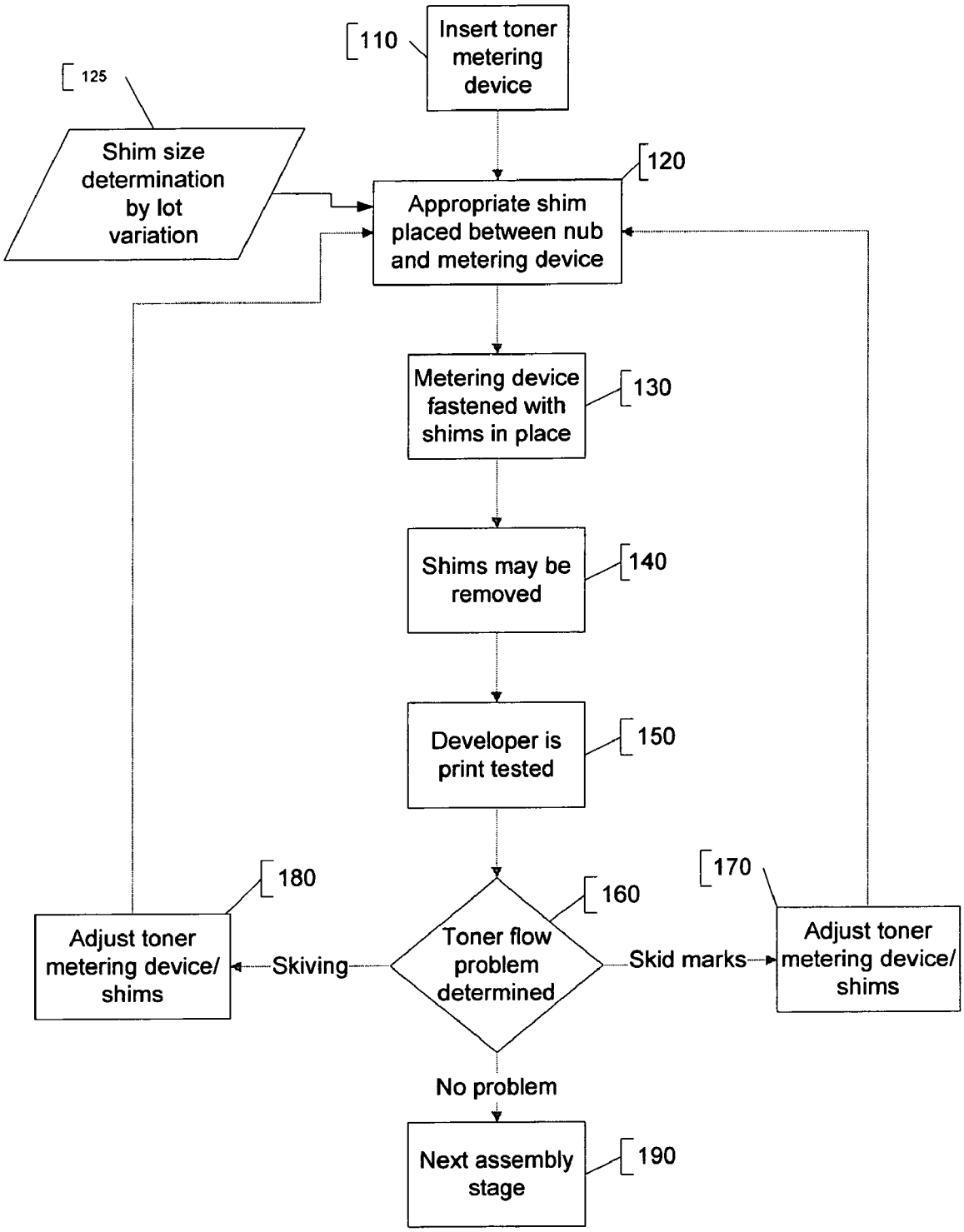
FIG. 6 is an exemplary embodiment of a method for determining the proper placement of the support member.

One embodiment of the present invention may relate to a method for adjusting the developing agent metering device 10*e*. An exemplary embodiment of the method is illustrated in FIG. 6. A developing agent metering device 10*e* may be provided at 110. The location of the developing agent metering device 10*e* may be adjusted using shims placed between the nub of the developer housing 40 and the bracket 32 or developing agent metering device 10*e* at 120. It should be appreciated that the shim size may be approximated by the developing agent developing device 10*e* lot mean and standard deviation at 125.

The bracket 32 may be affixed to the developer housing 12 using fasteners at 130. The shims may be removed at 140, however, it should be understood that the shims may be left in place and later affixed to the developer unit 12 once the desired location has been determined. The developer may then be print tested 150.

The results of the print test may be quantified as to whether skid marks or skiving is detected at 160. If skid marks are detected it may be necessary to adjust the tip to tangent value T as it would suggest that the value of T is too large for the given situation at 170. Alternatively, if skiving is detected it would suggest that the value of T is too small for the given situation and the value of T would again be appropriately adjusted at 180. The value of T may be adjusted as noted above by the use of shims which may engage with the bracket 32 and developer cartridge housing 40. Once the shims are employed and a subsequent evaluation is completed, the bracket may then be reaffixed to the developer housing 12 and the shims may be removed. Alternatively, the detection of skid marks may also include the step of replacement of the doctor blade which is then adjusted according to FIG. 6.

The foregoing description is provided to illustrate and explain the present invention. However, the description hereinabove should not be considered to limit the scope of the invention set forth in the claims appended here to.

What is claimed is:

1. A method of metering developing agent in an image forming device, the metering device having a length and end section, a component which supplies developing agent in contact with the metering device and a support member for engaging said developing agent metering device and a developer housing, comprising:

forming a contact location at a tangent location between said metering device and said component;

adjusting the distance between said end section to said tangent contact location by providing at least one shim placed between said support member and said developer housing;

positioning said support member in said developer housing, wherein said developing agent metering device is positioned in relation to said component; and fastening said support member to said developer housing.

2. The method of claim 1, further comprising print testing said imaging apparatus using said developing agent metering device.

3. The method of claim 2, further comprising determining if a print defect has occurred selected from the group consisting of skid marks and skiving.

4. The method of claim 3, further comprising reducing said at least one shim by a unit of width of at least 0.05 mm when skiving has been determined to occur.

5. The method of claim 3, further comprising adding at least one said shim by a unit of width of at least 0.05 mm when skid marks have been determined to occur.

6. The method of claim 1, wherein said at least one shim is provided according to a statistical measurement.

7. The method of claim 6, wherein said statistical measurement comprises:

determining a first variation related to a first population of developer housing and developing agent supply components;

determining a second variation related to a second population of developing agent metering device extension lengths;

determining a cumulative variation of said first variation and said second variation; and sizing said shims based on said cumulative variation.

8. The method of claim 7, wherein said sizing said shims based on said cumulative variation comprises accounting for a standard deviation of said second population of said developing agent metering device extension lengths.

9. A method of metering developing agent in an image forming device, the metering device having a length and end section, a component which supplies developing agent in contact with the metering device and a support member for engaging said developing agent metering device and a developer housing, comprising:

forming a contact location at a tangent location between said metering device and said component;

adjusting the distance between said end section to said tangent contact location;

shimming, in a direction approximately parallel to the plane of the developing agent metering device, said support member in said developer housing, wherein said developing agent metering device is positioned in relation to said component; and fastening said support member to said developer housing.

* * * * *